US009238898B1

(12) United States Patent
Johnson et al.

(10) Patent No.: US 9,238,898 B1
(45) Date of Patent: Jan. 19, 2016

(54) RAIN DIVERTER

(71) Applicants: Daniel John Johnson, Rochester, NY (US); Domenico Colaprete, Rochester, NY (US)

(72) Inventors: Daniel John Johnson, Rochester, NY (US); Domenico Colaprete, Rochester, NY (US)

( * ) Notice: Subject to any disclaimer, the term of this patent is extended or adjusted under 35 U.S.C. 154(b) by 0 days.

(21) Appl. No.: 14/844,065

(22) Filed: Sep. 3, 2015

Related U.S. Application Data

(60) Provisional application No. 62/046,611, filed on Sep. 5, 2014.

(51) Int. Cl.
*E02D 31/06* (2006.01)
*E04B 1/64* (2006.01)
*E03B 7/07* (2006.01)

(52) U.S. Cl.
CPC . *E02D 31/06* (2013.01); *E03B 7/07* (2013.01); *E04B 1/64* (2013.01)

(58) Field of Classification Search
CPC ..... E04D 2013/0813; E04D 13/0459; E02D 31/06; E03B 7/07; E04B 1/64; E04F 13/0733; E04F 2013/063
USPC ..... 52/16, 58–62, 97, 287.1, 741.1, 741.4
See application file for complete search history.

(56) References Cited

U.S. PATENT DOCUMENTS 822,131 A * 5/1906 Hyder ..... E06B 7/14 52/169.13
2,334,779 A * 11/1943 Luff ..... E04D 13/08 137/312
2,644,207 A * 7/1953 McCormack ..... E04F 10/08 52/78
2,966,171 A 12/1960 Kotlar
3,048,983 A * 8/1962 Crummel ..... E04D 13/08 404/2
3,375,851 A * 4/1968 Schif ..... E04D 13/08 137/120
3,636,830 A 1/1972 Watts
4,265,062 A * 5/1981 Klibofske ..... E04B 1/0007 52/169.11
5,358,007 A 10/1994 Carlberg
5,743,505 A * 4/1998 Sofy ..... A47G 33/12 248/346.01
5,832,675 A * 11/1998 Zuares ..... E04H 12/2292 52/170
6,449,910 B1 * 9/2002 Budd ..... E04D 13/0459 52/302.6
6,715,237 B2 * 4/2004 Batt, Sr. ..... E04D 13/1475 52/11
6,729,089 B1 * 5/2004 Spragg ..... E04H 12/2238 248/346.03
6,823,894 B1 11/2004 Koller
7,052,212 B1 * 5/2006 Joyner ..... E04D 13/08 405/119
8,006,720 B1 * 8/2011 Kotansky ..... E04D 13/08 137/873
8,091,296 B2 * 1/2012 Horn ..... E04B 1/00 52/101
2009/0003933 A1 1/2009 Anderson
2012/0085431 A1 4/2012 Spano

* cited by examiner

*Primary Examiner* — Brian Glessner
*Assistant Examiner* — Adam Barlow
(74) *Attorney, Agent, or Firm* — Louis S. Horvath

(57) ABSTRACT

A rainwater diverter shell has edge flashing with a right-angled flange formed by a first upper flange that defines a first vertical plane and a second upper flange that defines a second vertical plane orthogonal to the first. A first side flange extends between the first upper flange and a base and has a first side flange surface in parallel to the first vertical plane. A second side flange extends between the second upper flange and the base and has a second side flange surface in parallel to the second vertical plane. A horizontal base flange defines a base plane. The horizontal base flange extends along an arc that subtends a reflex angle between the first and second vertical planes. A sloped surface descends from the edge flashing to the horizontal base flange and extends across the rainwater diverter from the first side flange to the second side flange.

19 Claims, 9 Drawing Sheets

View C-C

RAIN DIVERTER

CROSS REFERENCE TO RELATED APPLICATIONS

The present application claims priority from U.S. Ser. No. 62/046,611 entitled "RAIN DIVERTER" and filed as a provisional patent application on Sep. 5, 2014 in the name of Daniel John Johnson et al., incorporated herein in its entirety.

FIELD OF THE INVENTION

The invention relates generally to drainage apparatus and methods for diverting rainwater away from a structure and more particularly relates to a rain diverter that redirects rainwater run-off from an exterior corner of a structure.

BACKGROUND OF THE INVENTION

Rainwater run-off from roofing and other surfaces, including overflow from gutters, downspouts, drainpipes, and other water-handling channels can cause appreciable erosion and other water-related damage to the interior and exterior of a building structure. Unless properly directed away from the building foundation, rainwater run-off can collect or flow around the sides of a house or other structure, leaking into basement areas, degrading above- and below-ground portions of the foundation, forming pits and holes and washing away soil and plants, and causing unpleasant or even unsafe conditions for those in and around the building.

Over centuries, a number of approaches have been devised for directing rainwater run-off away from a building foundation. Various types of splash blocks are available for re-directing gutter outflow. Splash blocks conventionally used include those made of concrete or plastic, generally flat and with various shapes, such as rectangular, possibly with side walls for reducing splash-over along the edges.

Downspout extensions have also been designed to help solve the run-off problem. Largely tubular, these devices connect to the existing downspout opening and channel the output flow to some distance away from the opening. Downspout devices that extend the gutter system can be rigid or flexible, can fold away or be permanently extended, and are commonly formed from sheet metal or plastic.

As is well known, each type of solution that has been developed for handling this problem faces a number of limitations. Splash blocks, for example, are often quite heavy and can obstruct easy building access. More importantly, splash blocks direct all of the water flow in a single direction. With heavy rainfall, splash blocks can be ineffective, allowing splash-over or simply redirecting excess water for pooling at some alternate location. Downspout extensions, although helpful in some situations, typically require regular maintenance to prevent clogging and can present a tripping hazard for those walking near the structure. Neither splash blocks nor downspout extensions spread the rainwater over a broad angular span; instead, the run-off often tends to pool in low areas or to cause erosion in some cases.

Outside corners of a building are particularly prone to problems in handling rainwater run-off and are poorly served by conventional rain-handling solutions. Downspouts are often located along outside corners, channeling water downwards at corners from upper gutter and sloped-roof structures, often at significant pressure. In addition, overflow of gutters at these points, due to high volume or blockage of drain holes, can lead to significant amounts of water flowing down from the roof, outside and alongside the downspouts. Unless some type of rain diversion device at the outside corner is capable of accepting and redirecting high volumes of water, as well as handling water that may not be properly channeled through the appropriate downspouts, there is risk of overflow, erosion, and other damage.

Splash blocks and other conventional rainwater diverters often fail to provide sufficient protection along outside corners. Even when they work well, these devices tend to direct all of the water into a single area, resulting in localized pooling or erosion under heavy rain conditions.

Another problem that has not been addressed using conventional splash blocks and rainwater diverters relates to unwanted pests of many kinds that can use these devices as hiding or nesting places, as well as weeds, algae, and other plant life that can find conventional splash blocks favorable for supporting growth. Heavy concrete splash blocks are difficult to move once they are positioned and other proposed solutions make it difficult to clean and maintain areas near the foundation of a house or other building.

It can be appreciated that there remains a need for a rainwater diverter that is particularly effective along outside corners of a building structure and that can be easily installed and used to reduce erosion and other water-related damage.

SUMMARY OF THE INVENTION

An object of the present invention is to address the need for a rainwater diverter for a building structure. Advantageously, embodiments of the present disclosure describe a rainwater diverter that can be easily installed as well as removed and that works effectively to redirect the flow of water from gutters and downspouts along an outside corner of a building. The rainwater diverter distributes rainwater run-off over a large angular area to help reduce pooling and erosion.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided a rainwater diverter formed as a rigid unitary shell comprising:

a) an edge flashing having:
   (i) a right-angled flange formed by a first upper flange that defines a first vertical plane and a second upper flange that defines a second vertical plane that is orthogonal to the first vertical plane;
   (ii) a first side flange that extends between the first upper flange and a base of the rainwater diverter, the first side flange having a first side flange surface that extends in parallel to the first vertical plane and;
   (iii) a second side flange that extends between the second upper flange and the base of the rainwater diverter, the second side flange having a second side flange surface that extends in parallel to the second vertical plane;

b) a horizontal base flange that forms the base of the shell and that defines a base plane that is orthogonal to both of the first and second vertical planes, wherein the horizontal base flange extends along an arc that subtends a reflex angle between the first vertical plane and the second vertical plane;

and c) a sloped surface that descends from the edge flashing to the horizontal base flange and extends across the rainwater diverter from the first side flange to the second side flange.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
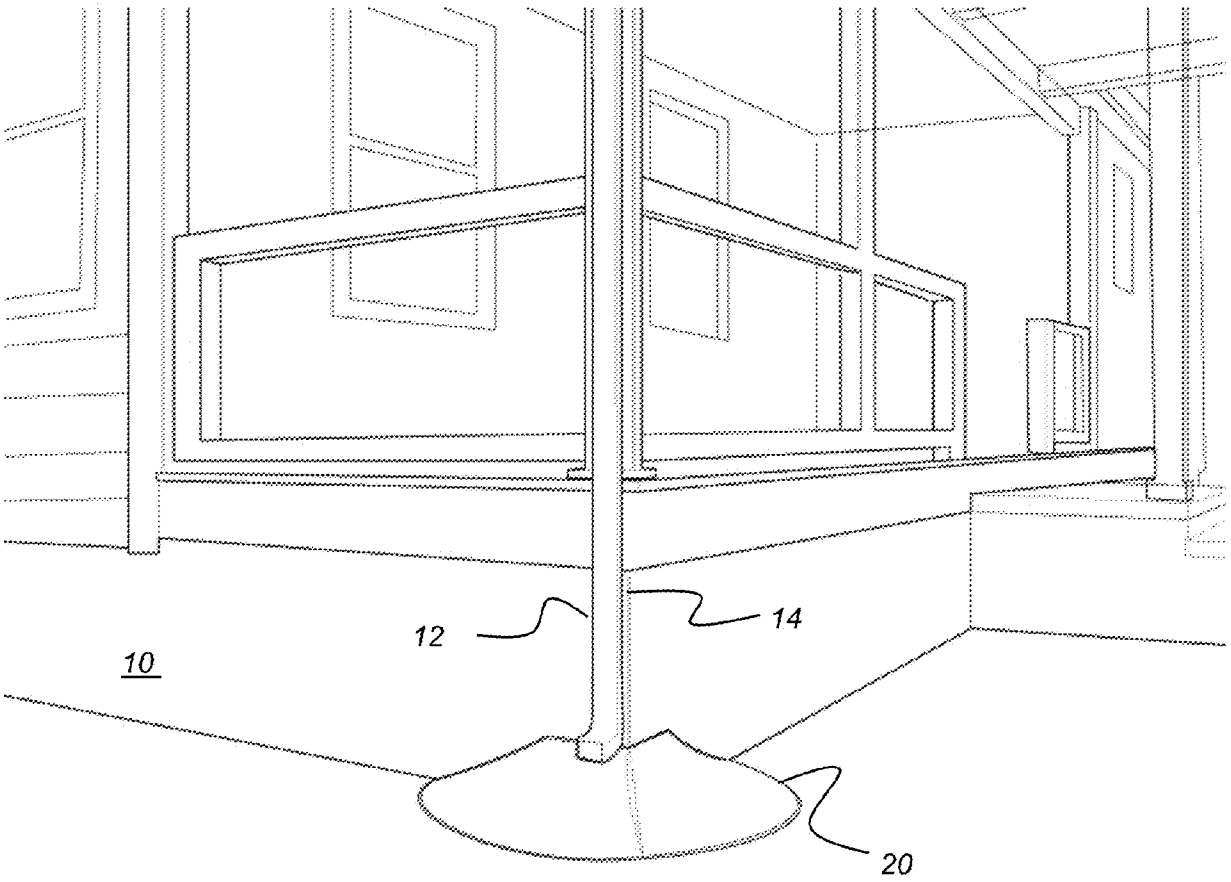
FIG. 1 shows a perspective view of the rainwater diverter in use according to an embodiment of the present disclosure.

The following is a detailed description of the preferred embodiments of the invention, reference being made to the drawings in which the same reference numerals identify the same elements of structure in each of the several figures.

Where they are used, the terms "first", "second", and so on, do not necessarily denote any ordinal or priority relation, but may be used for more clearly distinguishing one element or time interval from another.

The term "exemplary" indicates that the description is used as an example, rather than implying that it is an ideal.

In the context of the present disclosure, the term "unitary" has its standard connotation meaning formed in a single piece or unit.

The term "orthogonal" or "substantially orthogonal" describes a relationship of two structures that are at a 90 degree (+/−6 degree) angle with relation to each other.

In the context of the present disclosure, the term "rigid" is used to indicate a structure with sufficient stiffness to be self-supporting and to maintain its shape without external support. Stiffness relates to the ability of a structure to maintain its shape under stress and to restore its shape after bending or stretching force is removed. A rigid, stiff structure, also termed a "substantially rigid" structure, has sufficient flexural modulus and sufficient flexural strength so that, while it may be somewhat pliable, it resists bending by hand and, if momentarily bent by hand, can resume its original form and surface curvature, or very close to its original form and curvature. A substantially rigid shell structure can have some pliability but restores its shape after pressure from normal handling and installation, such as from being seated or pressed into position for its intended use.

In the context of the present disclosure, the phrases "define a plane" and "lie within a plane" have their standard meaning as widely used in geometrical description. A plane can be defined by any three points that are not on the same line. Two lines or two flat 2-dimensional surfaces may lie within or define the same plane, if the lines or surfaces lie wholly within the plane. A surface contingent to a plane can have a line or surface of contact that effectively defines the plane.

In the context of the present disclosure, the term "reflex angle" has its standard meaning as used by those in mathematical fields and indicates an angle that measures in excess of 180 degrees.

Embodiments of the present disclosure describe a rainwater diverter shell, or more simply, a rain diverter shell, an apparatus that is designed to redirect rainwater run-off from a downspout or other mechanism so that the resulting distribution of rainwater run-off from the roof, from gutters, and from downspouts is broadly spread over a sizable angular range. Using the rain diverter shell apparatus, rainwater can be diverted from an outside corner of a house or other building structure, helping to minimize or eliminate erosion and reduce the risk of localized flooding around the building foundation.

Figure 2:
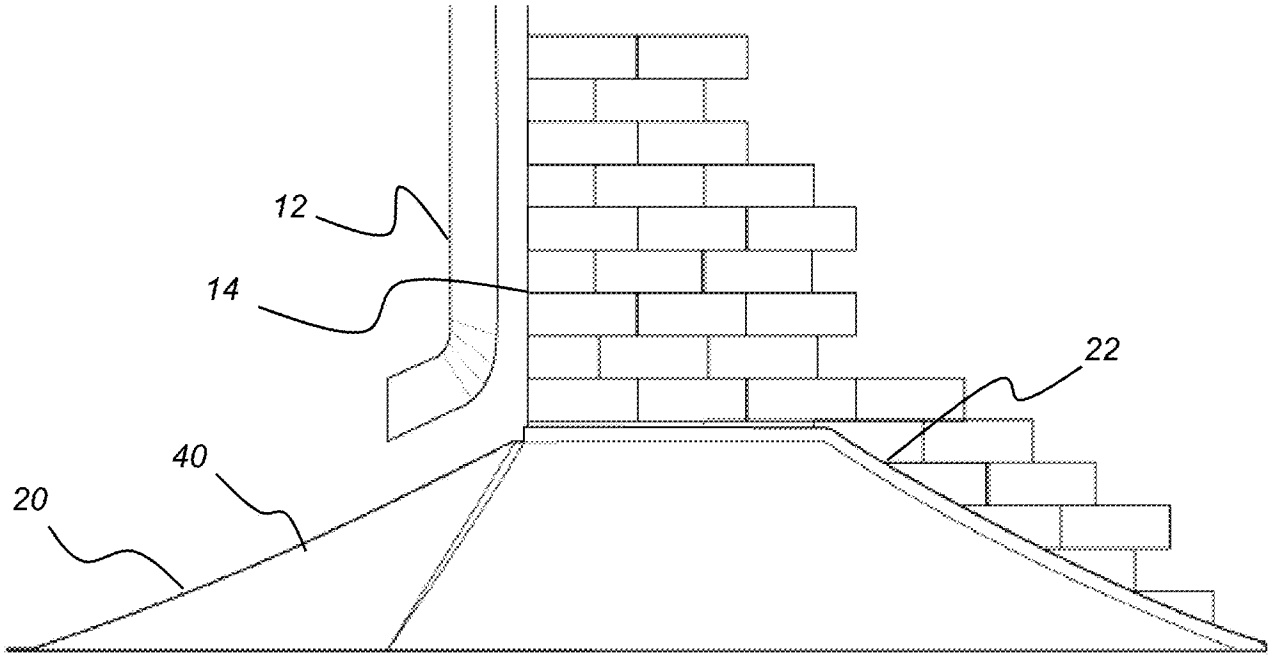
FIG. 2 is a side view that shows a rainwater diverter shell used to redirect water from a downspout.

The perspective view of FIG. 1 and side view of FIG. 2 show a rainwater diverter shell 20 of an embodiment of the present disclosure installed at an outside corner 14 of a home or other building 10, such as at the base of a downspout 12. Rainwater diverter shell 20 is fitted against a right-angled outside corner 14 for redirecting downspout 12 water output. A flashing 22 along outer edges of rainwater diverter shell 20, as described in more detail subsequently, allows rainwater diverter shell 20 to hug the foundation walls that form corner 14. Flashing 22 helps to guide water onto a sloped surface 40 of rainwater diverter shell 20 and helps in reducing or eliminating water flow between rainwater diverter shell 20 and the building structure.

Figure 3:
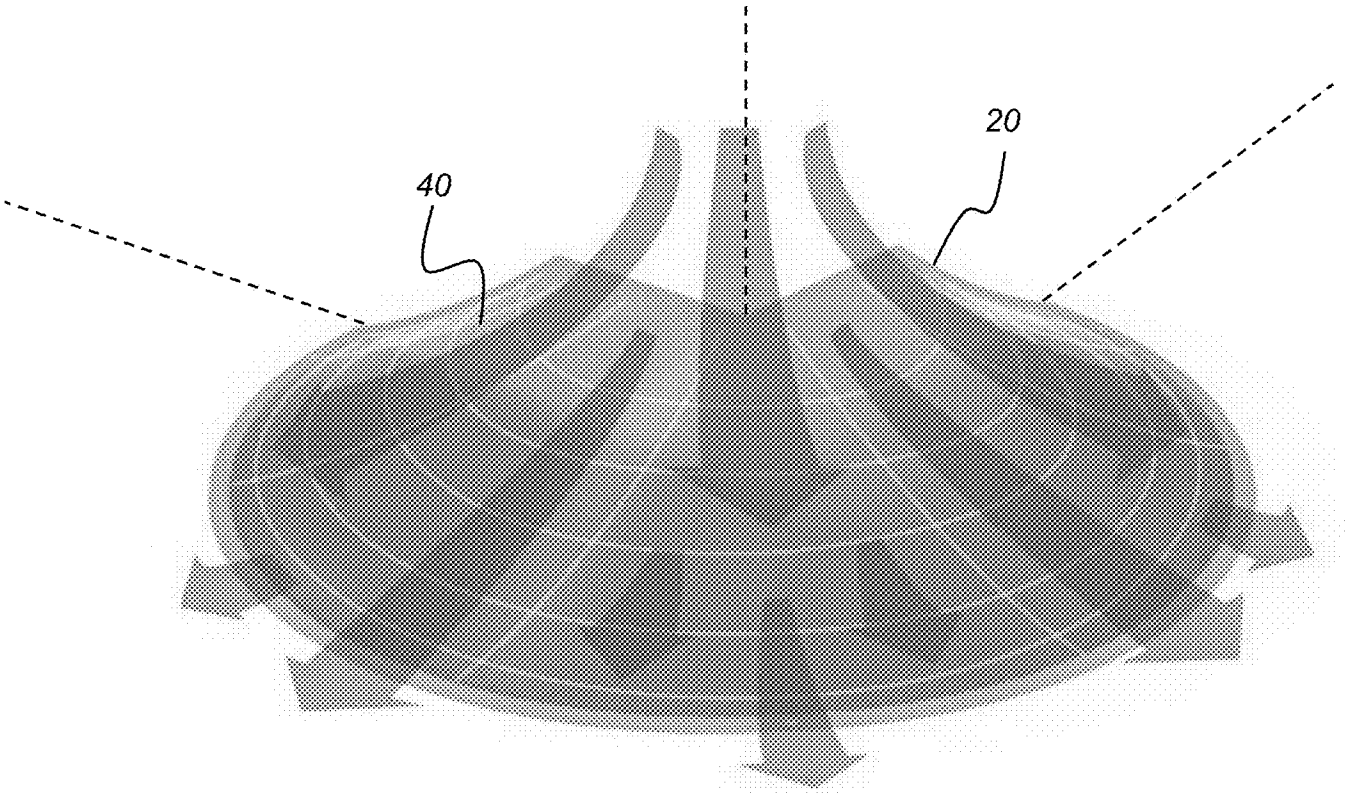
FIG. 3 is a perspective view that shows idealized rainwater diversion over the surface of a rainwater diverter shell according to an embodiment of the present disclosure.

The perspective view of FIG. 3 schematically shows how rainwater diverter shell 20 operates, in idealized form. Rainwater flow, represented by the outgoing arrows, spreads the water outward from the curved surface 40 and away from the foundation, with water distribution over as much as a 270 degree angle. In order to perform this function and to reduce the likelihood of rainwater flowing back against the foundation, rainwater diverter shell incorporates particular design features.

Figure 4A:
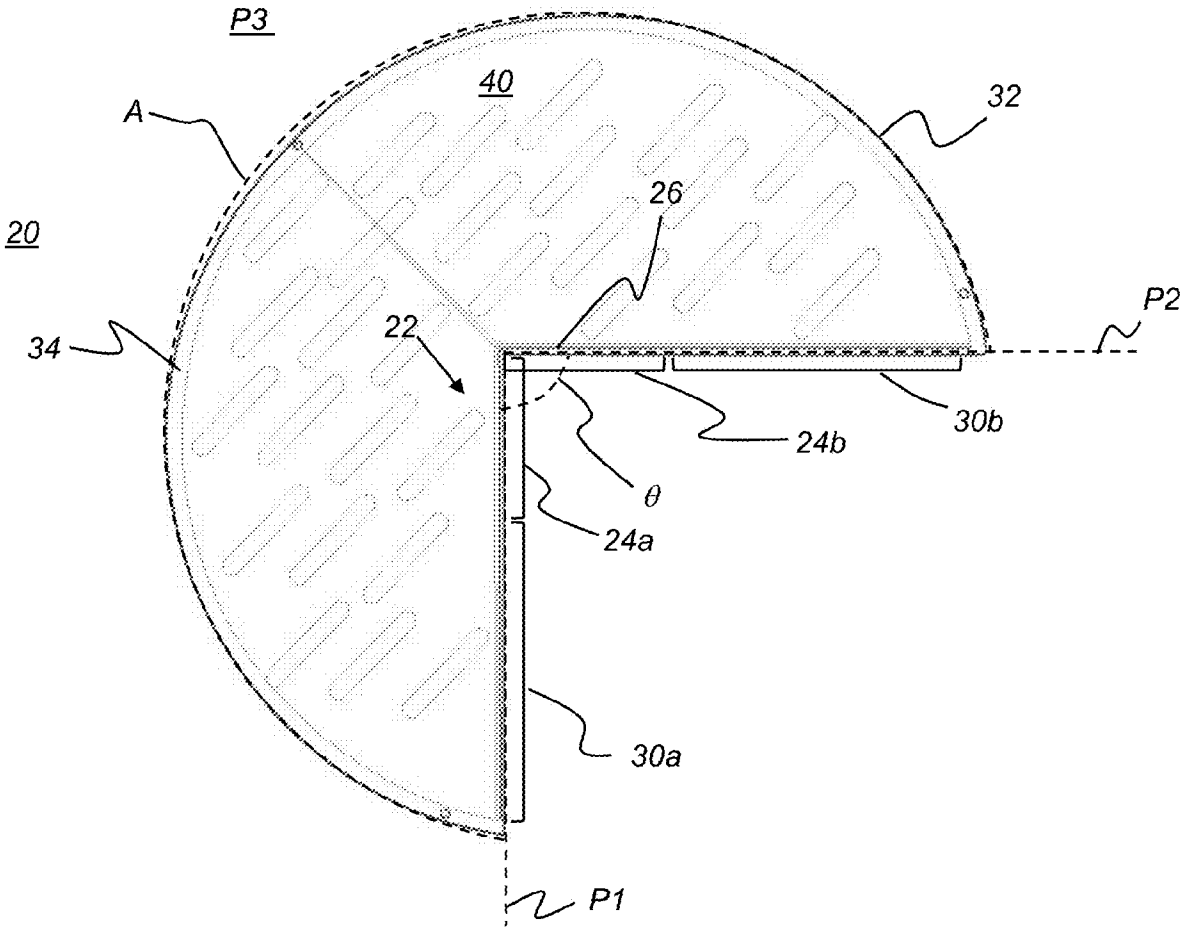
FIG. 4A is a top view showing a rainwater diverter shell according to an embodiment of the present disclosure.
Figure 4B:
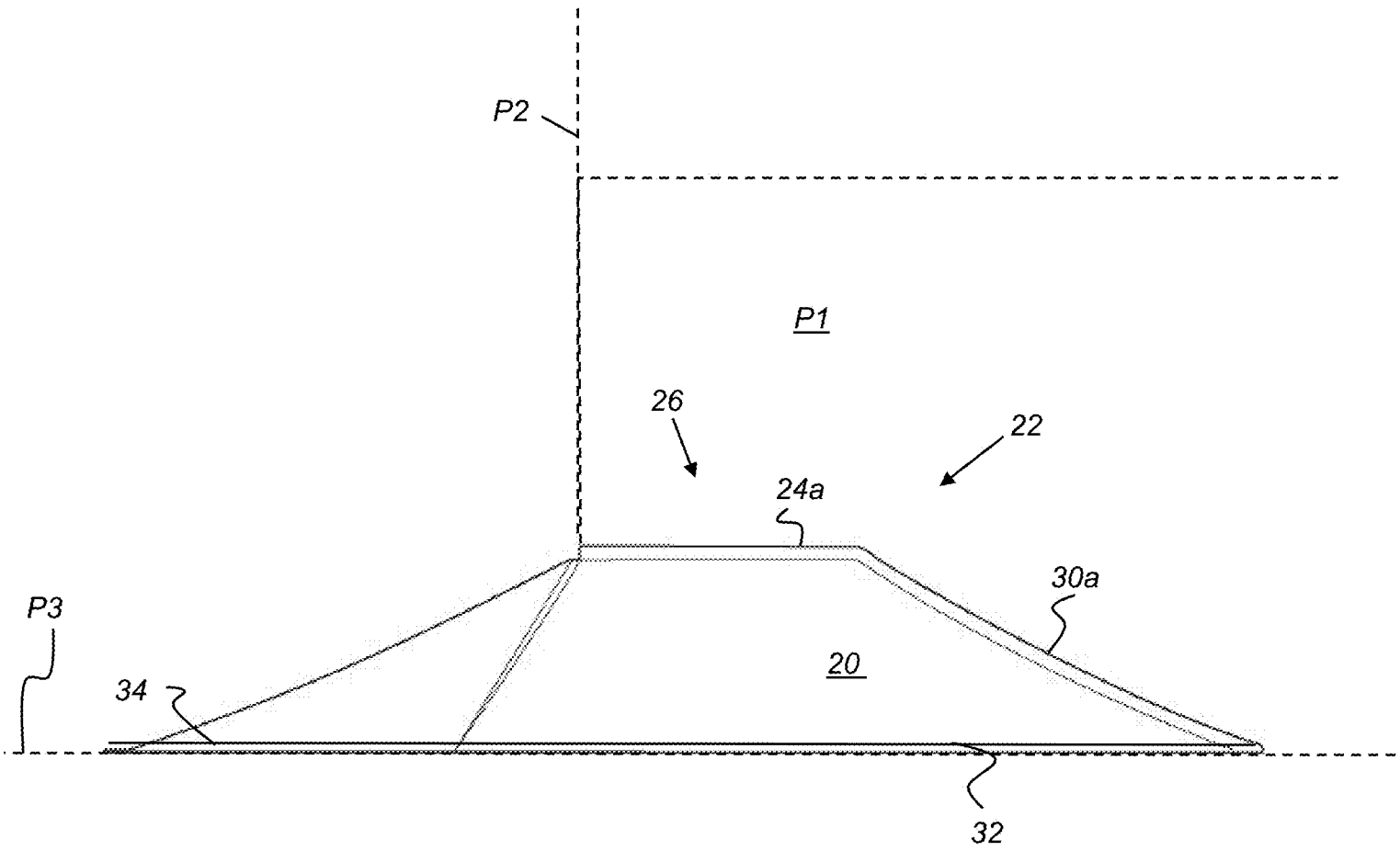
FIG. 4B is a side view of a rainwater diverter shell according to an embodiment of the present disclosure.
Figure 4C:
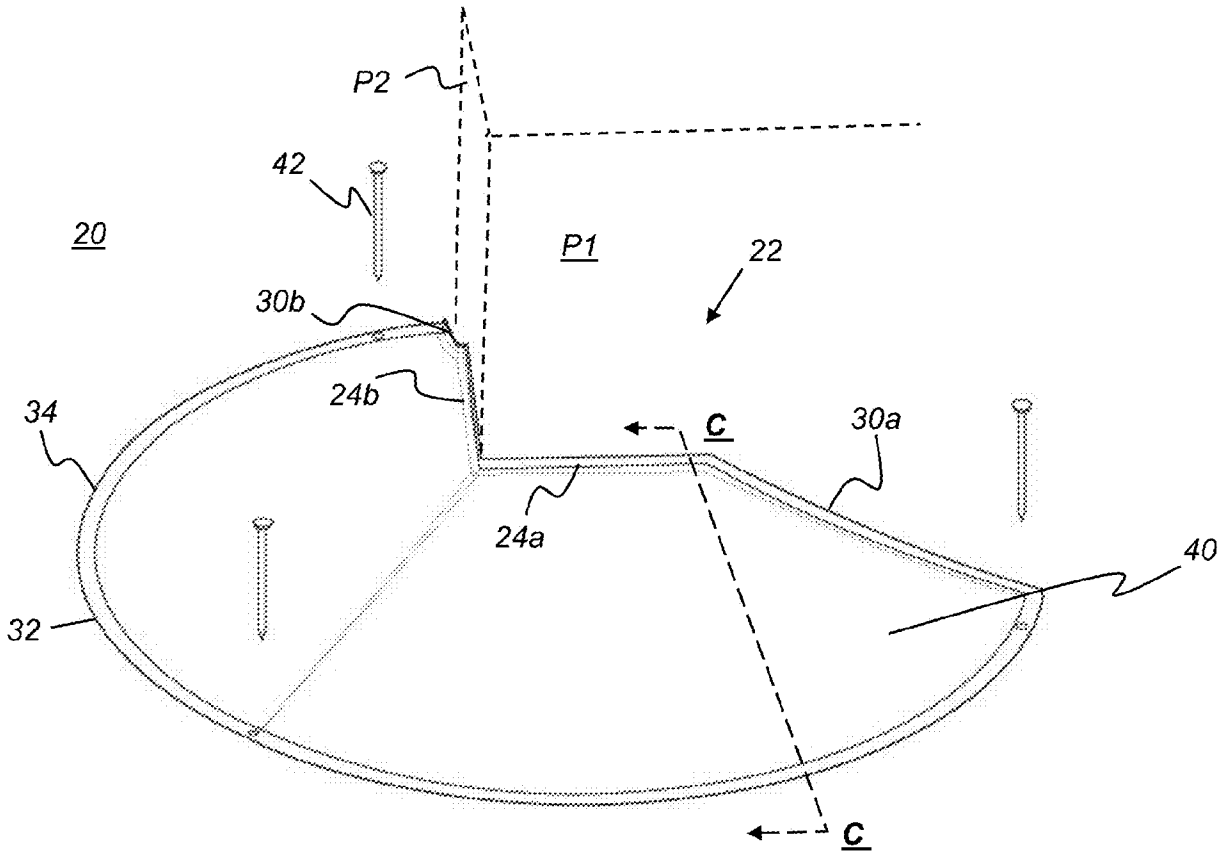
FIG. 4C is a perspective view of a rainwater diverter shell according to an embodiment of the present disclosure.

FIG. 4A is a top view, FIG. 4B a side view, and FIG. 4C a perspective view of rainwater diverter shell 20 according to an embodiment of the present disclosure. A flashing 22 has a right-angled upper flange 26 that fits against the outside corner as was shown with reference to FIGS. 1 and 2. Right-angled upper flange 26 has upper flange sections 24*a* and 24*b* that are orthogonal to each other, intersecting each other at a right angle θ. Flange section 24*a* defines, or lies along, a vertical plane P1 that corresponds to one side of the building against which rainwater diverter shell 20 is fitted. Flange section 24*b* defines, or lies along, a vertical plane P2 that is orthogonal to plane P1; plane P2 corresponds to the orthogonal side of the building against which rainwater diverter shell 20 is fitted. A side flange 30*a* extends downwards from upper flange section 24*a* to a base 32. Side flange 30*a* also has a facing surface that lies along or is in parallel to plane P1. In similar fashion, a side flange 30*b* extends downwards from upper flange section 24*b* to base 32. Side flange 30*b* lies along or presents a facing surface that is parallel to plane P2.

As shown in FIGS. 4B and 4C, sloped surface 40 descends from flashing 22 towards a horizontal base flange 34. Horizontal base flange 34 forms the base 32 of the rainwater diverter 20 shell and defines, or lies along, a base plane P3 that is orthogonal to both of the first and second vertical planes P1 and P2. The horizontal base flange 34 extends along a 270-degree arc A (shown by a dashed line) that subtends the reflex angle (270 degrees or 360 degrees minus θ) between the first vertical plane P1 and the second vertical plane P2. Horizontal base flange 34 can be arcuate, as shown in FIG. 4A, or can have one or more straight segments that are arranged to incrementally approximate the arcuate 270-degree path outlined by arc A.

For reference, vertical plane P1 is orthogonal to (is directed outward from) the sheet from the top view of FIG. 4A and is parallel to the sheet in the side view of FIG. 4B. Vertical plane P2 is orthogonal to the sheet from the top view of FIG. 4A and orthogonal to the sheet in the side view of FIG. 4B. Base plane P3 is parallel to the sheet in the top view of FIG. 4A and orthogonal to the sheet in the side view of FIG. 4B.

Figure 5:
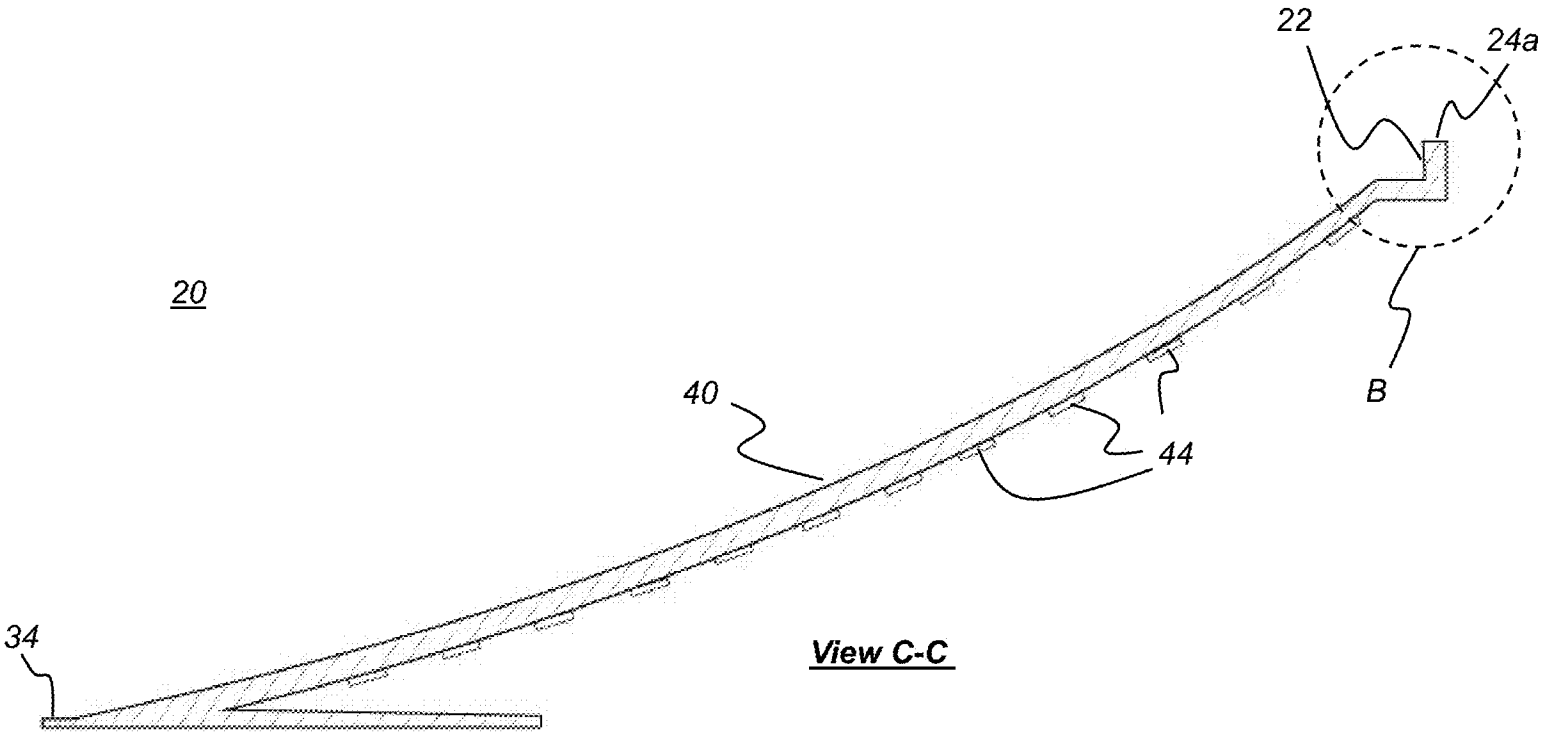
FIG. 5 is a cross-sectional view of the rainwater diverter shell from a view indicated in FIG. 4C.

FIG. 5 shows a side view cross section of raid diverter shell 20, taken from the C-C section line location indicated in FIG. 4C. Rainwater diverter shell 20 is hollow, but may have one or more supporting ribs 44 for added structural strength; ribs 44 can extend horizontally along sloped surface 40, as shown in the cross section of FIG. 5. Sloped surface 40 can be flat, convex, or concave. As shown in the cross-sectional view of FIG. 5, a slight surface 40 concavity can be provided. In this exemplary embodiment, base flange 34 has a portion that extends inward to provide additional support.

Figure 6B:
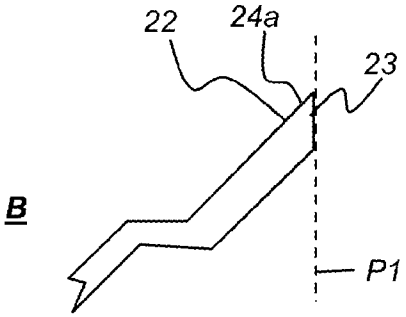
FIGS. 6A, 6B, and 6C are enlarged cross-section views that show different arrangement for a flange facing surface relative to a vertical plane.
Figure 6A:
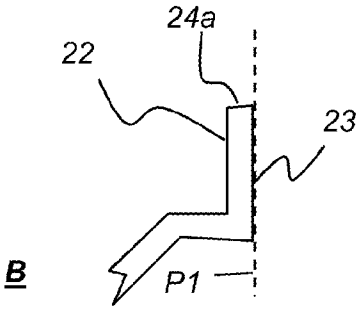
Figure 6C:
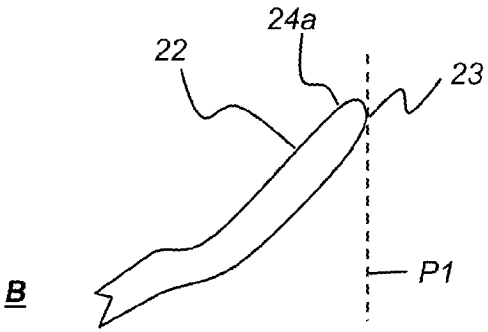

FIGS. 6A, 6B, and 6C then show, in enlarged form in a view B, different arrangements of flashing 22 using the upper flange 24*a* area by way of example and show how the flanges that form flashing 22 relate to vertical planes P1 and P2.

Referring to FIGS. 6A-6C, in terms used herein to define structural features, a flange, such as flange 24*a*, is considered to have a facing surface 23. The facing surface 23 of a flange may be a continuous contact surface, at the interface of the flange and an adjacent structure as in FIG. 6A, or may simply be a contact surface portion that extends furthest outward along the flange with respect to an orthogonal axis and extends over most of the length of the flange. A flange defines a plane that is parallel to, or adjacent along, its facing surface or contact surface.

In the example shown in FIGS. 4A-4C and in FIGS. 6A-6C, flange 24*a* defines vertical plane P1 along its facing surface 23. FIG. 6A shows an embodiment of the present disclosure in which both flange 24*a* and facing surface 23 are vertical. FIG. 6B shows an alternate embodiment of the present disclosure in which flange 24*a* is not vertical but its facing surface 23 is vertical. FIG. 6C shows another alternate embodiment of the present disclosure in which flange 24*a* is not vertical and its facing surface 23 is nonvertical, but is the furthest extension of a continuous rounded surface. In each of the cases shown in FIGS. 6A-6C, the continuous facing surface 23 of the flange defines or extends in parallel to a vertical plane P1 that is orthogonal to vertical plane P2, similarly defined earlier, and also orthogonal to horizontal plane P3 (FIGS. 4A and 4B).

The arrangement of features along surfaces of rainwater diverter shell 20 enable this device to divert rainwater run-off away from the building corner 14 and surrounding foundation. Considering FIG. 4A in particular, flashing 22 has the following parts: right-angled upper flange 26, side flange 30*a*, and side flange 30*b*. The surfaces provided by flashing 22 that lie in, or are at least parallel to, plane P1 are from upper flange section 24*a* and side flange 30*a*. The surfaces provided by flashing 22 that lie in or are at least parallel to plane P2 are from upper flange section 24*b* and side flange 30*b*. The progression of various flange surfaces provides a continuous, or substantially continuous, flashing that frames the right angle that is formed along the outside corner of a building against which the rainwater diverter shell 20 is fitted. The 270 degree reflex angle span of the horizontal base flange 34 distributes water over a broad area, as described previously.

It should be noted that any of the flange surfaces can be featured, including with standoffs or holes for accepting fasteners, for example. FIG. 4C shows fasteners 42 for staking base 32 to the ground surface. The flashing 22 surfaces can be designed to be fastened or adhered to the building surface, but can also simply be butted up against the surface when rainwater diverter shell 20 is installed. Flange surfaces can be featured to accept fasteners, such as having drilled holes or molded holes or cavities for screws, stakes, or other fasteners. According to an embodiment of the present disclosure, the weight of water against the surface 40 serves to slightly distort the shape of rainwater diverter shell 20 and can force at least portions of the flashing 22 into contact against the building surface, providing an improved seal. A caulked seal can alternately be provided as part of diverter shell 20 installation. Gasketing, such as a foam or rubber liner, may also be provided, such as to improve the seal along the edges of flashing 22 surfaces.

Figure 7:
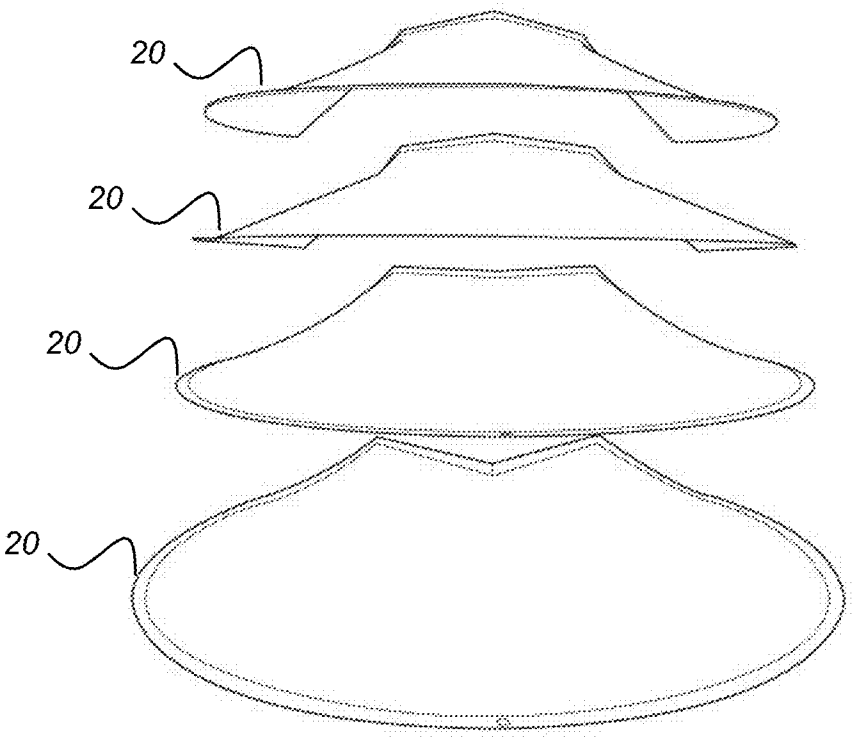
FIG. 7 is a perspective view that shows stacking of multiple rainwater diverter shells.

Because it is designed in the form of a hollow shell, rainwater diverter shell 20 can be easily fabricated, shipped, stored, and displayed for retail sale without occupying significant amounts of floor or shelf space. By way of example, FIG. 7 is a perspective exploded view that shows stacking of multiple rainwater diverter shells 20.

Shell 20 Fabrication

Rainwater diverter shell 20 can be molded or otherwise formed from a suitable material in a number of ways. Exemplary materials having levels of stiffness and rigidity suitable for construction of the rainwater diverter shell of the present disclosure include plastics such as PVDF (Polyvinylidine fluoride), a whitish or translucent solid having flexural strength of about 90 MPa and flexural modulus of about 2.0 GPa; HDPE (high density polyethylene) having flexural strength of about 13.8-48.3 MPa and flexural modulus in the range from 0.280-4.42 GPa; Polycarbonate having flexural strength of about 90 MPa and flexural modulus of about 2.3 GPa. Still other possible plastic materials that can be used include: acrylonitrile butadiene styrene (ABS); Acrylic; Nylon; Polyamide; Polyimide; Polyethylene; Polyethylene Terephthalate (PET); Polypropylene; and Polystyrene, for example.

Alternately, other types of materials can be used, including fiberglass and other composites. Metals, such as tin and galvanized steel can alternately be used.

Thickness of the shell walls and flange features depends on the material that is being used and the fabrication process. According to an embodiment of the present disclosure, using a thermoform process, shell thickness is in the range from ⅛ to 3/16-inches. An embodiment of the present disclosure fabricated using injection molding forms a shell thickness in the 1/16 inch range.

Rainwater diverter shell 20 can be opaque. Alternately, rainwater diverter shell 20 can be fabricated from various types of translucent materials that transmit more than 10 percent of incident light. Translucent materials can include transparent materials that transmit 70 percent or more of incident light or semi-transparent materials that transmit from about 40 percent of incident light to about 70 percent. The use of transparent or semi-transparent materials would permit a house owner or building maintenance personnel to readily determine whether cleaning is needed for algae, mold, or other growth. Transparency also allows visibility as to whether or not the diverter shell is being used by animal or insect pests, slugs, snakes, or other creatures not generally desired near the building foundation.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A rainwater diverter formed as a rigid unitary shell comprising:

a) an edge flashing having:

(i) a right-angled flange formed by a first upper flange that defines a first vertical plane and a second upper flange that defines a second vertical plane that is orthogonal to the first vertical plane;

(ii) a first side flange that extends between the first upper flange and a base of the rainwater diverter, the first side flange having a first side flange surface that extends in parallel to the first vertical plane and;

(iii) a second side flange that extends between the second upper flange and the base of the rainwater diverter, the second side flange having a second side flange surface that extends in parallel to the second vertical plane;

b) a horizontal base flange that forms the base of the shell and that defines a base plane that is orthogonal to both of the first and second vertical planes, wherein the horizontal base flange extends along an arc that subtends a reflex angle between the first vertical plane and the second vertical plane;

and c) a sloped surface that descends from the edge flashing to the horizontal base flange and extends across the rainwater diverter from the first side flange to the second side flange.

2. The rainwater diverter of claim 1 wherein the shell is formed from a transparent material.

3. The rainwater diverter of claim 1 wherein the shell is formed from a translucent material.

4. The rainwater diverter of claim 1 wherein the sloped surface is concave with respect to a vertical cross section.

5. The rainwater diverter of claim 1 wherein the shell is formed from a plastic.

6. The rainwater diverter of claim 1 wherein the shell is formed from a composite.

7. The rainwater diverter of claim 1 wherein the first upper flange is a vertical flange.

8. The rainwater diverter of claim 1 wherein the shell is formed from a metal.

9. The rainwater diverter of claim 1 wherein one or more of the first and second upper flanges are featured in order to accept fasteners.

10. A rainwater diverter shell comprising:

a) a first upper flange and a second upper flange that intersects the first upper flange at a right angle;

b) a first side flange that extends from the first upper flange towards a base of the rainwater diverter shell, and wherein edges of the first upper flange and the first side flange define a first vertical plane;

c) a second side flange that extends from the second upper flange towards the base of the rainwater diverter shell, and wherein the second upper flange and the second side flange define a second vertical plane that is orthogonal to the first vertical plane;

d) a horizontal base flange along the base of the rainwater diverter shell, wherein the base flange defines a base plane that is orthogonal to both of the first and second vertical planes, wherein the horizontal base flange extends along an arc that subtends a reflex angle between the first vertical plane and the second vertical plane;

and e) a sloped surface that descends from the first and second upper flanges to the horizontal base flange and extends across the rainwater diverter shell from the first side flange to the second side flange.

11. The rainwater diverter of claim 10 wherein the shell is formed from a plastic.

12. The rainwater diverter of claim 10 wherein the shell is formed from a composite.

13. The rainwater diverter of claim 10 wherein the first upper flange is a vertical flange.

14. The rainwater diverter of claim 10 wherein one or more of the first and second upper flanges are featured in order to accept fasteners.

15. The rainwater diverter of claim 10 wherein the shell is formed from a transparent material.

16. The rainwater diverter of claim 10 wherein the shell is formed from a translucent material.

17. The rainwater diverter of claim 10 wherein the sloped surface is concave with respect to a vertical cross section.

18. The rainwater diverter of claim 10 wherein the shell is formed from a plastic.

19. A method for diverting rainwater run-off from a building foundation, the method comprising:

a) forming a rigid unitary shell having:

(i) an edge flashing comprising:

a right-angled flange formed by a first upper flange that defines a first vertical plane and a second upper flange that defines a second vertical plane that is orthogonal to the first vertical plane;

a first side flange that extends between the first upper flange and a base of the shell, the first side flange having a first side flange surface that extends in parallel to the first vertical plane and;

a second side flange that extends between the second upper flange and the base of the shell, the second side flange having a second side flange surface that extends in parallel to the second vertical plane;

(ii) a horizontal base flange that forms the base of the shell and that defines a base plane that is orthogonal to both of the first and second vertical planes, wherein the horizontal base flange extends along an arc that subtends a reflex angle between the first vertical plane and the second vertical plane;

and (iii) a sloped surface that descends from the edge flashing to the horizontal base flange and extends across the shell from the first side flange to the second side flange;

and b) fitting the shell against an outside corner of the building foundation, with flanges placed against vertical sides of the foundation.

* * * * *